US010370208B2

(12) United States Patent
Sander et al.

(10) Patent No.: US 10,370,208 B2
(45) Date of Patent: Aug. 6, 2019

(54) BATCH FEEDER FOR PIECE GOODS MADE OF FLAT MATERIAL

(71) Applicant: INDAG Pouch Partners GmbH, Eppelheim (DE)

(72) Inventors: Jörg Sander, Heidelberg (DE); Roland Treu, Nussloch (DE); Josef Weis, Nussloch (DE)

(73) Assignee: INDAG POUCH PARTNERS GMBH, Eppelheim (DE)

( * ) Notice: Subject to any disclaimer, the term of this patent is extended or adjusted under 35 U.S.C. 154(b) by 0 days.

(21) Appl. No.: 15/497,868

(22) Filed: Apr. 26, 2017

(65) Prior Publication Data

US 2017/0313529 A1 Nov. 2, 2017

(30) Foreign Application Priority Data

Apr. 27, 2016 (EP) ..... 16167303

(51) Int. Cl.
*B65H 3/30* (2006.01)
*B65H 3/08* (2006.01)
(Continued)

(52) U.S. Cl.
CPC ..... *B65H 3/30* (2013.01); *B65H 1/06* (2013.01); *B65H 1/24* (2013.01); *B65H 3/085* (2013.01);
(Continued)

(58) Field of Classification Search
CPC ... B65H 1/06; B65H 1/08; B65H 1/10; B65H 1/20; B65H 1/24; B65H 3/08;
(Continued)

(56) References Cited

U.S. PATENT DOCUMENTS 5,219,092 A * 6/1993 Morand ..... A47K 10/424 221/191
5,941,681 A * 8/1999 Piotrowski ..... B65H 1/06 271/106
(Continued)

FOREIGN PATENT DOCUMENTS

DE 3237943 A1 4/1984
DE 19710236 A1 9/1997
JP 2014065576 A 4/2014

OTHER PUBLICATIONS

EP16167303.3; European Search Report; dated Oct. 19, 2016, pp. 1-8.

*Primary Examiner* — Prasad V Gokhale
(74) *Attorney, Agent, or Firm* — Mayer Brown LLP

(57) ABSTRACT

The present invention provides, in various embodiments, a batch feeder and a method for stocking and gravity conveying of piece goods made of flat material. A feeder pit comprises an upper opening for inputting the piece goods in batches, a lower opening for extraction of the piece goods, and at least two lateral pit delimitations, which are located opposite to one another, for guiding of the piece goods. As carrying structures for supporting the piece goods on one side, that are arranged on top of each other as floors and that protrude into the feeder pit, are formed on at least one of the pit delimitations, the piece goods can be retained alternatingly on the carrying structures in an easy way and advance respectively for each floor.

20 Claims, 3 Drawing Sheets

(51) Int. Cl.
*B65H 1/06* (2006.01)
*B65H 1/24* (2006.01)
*B65H 3/34* (2006.01)

(52) U.S. Cl.
CPC ..... *B65H 3/34* (2013.01); *B65H 2405/1142* (2013.01); *B65H 2701/191* (2013.01)

(58) Field of Classification Search
CPC ..... B65H 3/0808; B65H 3/085; B65H 3/30; B65H 3/32; B65H 3/66; B65H 3/68; B65H 2404/74; B65H 2404/741; B65H 2404/7412; B65H 2404/7414; B65H 2405/114; B65H 2405/1142; B65H 2405/11425; B65H 2405/1144
See application file for complete search history.

(56) References Cited

U.S. PATENT DOCUMENTS 6,098,839 A * 8/2000 Hunnell ..... B65H 1/06 221/197
6,419,113 B1 * 7/2002 Tramontina ..... A47K 10/424 221/45
6,682,065 B2 * 1/2004 Leonarde ..... B65B 41/06 271/104
9,187,273 B2 * 11/2015 Kodama ..... B65H 3/68
2001/0042953 A1 * 11/2001 Honda ..... B65H 1/06 271/10.11
2002/0125628 A1 * 9/2002 Chen ..... B65H 1/06 271/10.12
2006/0157911 A1 * 7/2006 Learmonth ..... B65H 3/0661 271/113
2016/0031661 A1 * 2/2016 Hiyama ..... B65H 3/063 271/165

* cited by examiner

BATCH FEEDER FOR PIECE GOODS MADE OF FLAT MATERIAL

RELATED APPLICATIONS

This application claims the benefit of, and priority to, European Patent Application No. 16167303.3, filed Apr. 27, 2016, which is incorporated by reference herein in its entirety.

BACKGROUND

Piece goods made of flat material, for example folded bags or sleeves as well as foil cuts in general, are used as a raw material for packaging, in particular of liquid products, and are provided for the production of the packagings in batch feeders. Such feeders are based preferably on a gravity conveying mechanism by means of an advancing process of the piece goods and comprise for this purpose a feeder pit with an upper opening for batch-based feeding of the piece goods and with a lower opening for automated extraction of individual piece goods, for example by means of sucking mechanisms. Improved batch feeders for piece goods made of flat material are needed in the art.

SUMMARY

The present disclosure relates to batch feeders and methods for stocking and gravity conveying of piece goods made of flat material.

In some embodiments, the invention provides a batch feeder comprising a feeder pit for stocking and gravity conveying of piece goods made of flat material in a downward conveying direction, the feeder pit comprising an upper opening for batch-based feeding of the piece goods, a lower opening for extraction of the piece goods, and at least two lateral pit delimitations comprising a first pit delimitation and a second pit delimitation located opposite to one another, for guiding of the piece goods. Carrying structures are formed on the first pit delimitation for supporting the piece goods on one side, the carrying structures arranged on top of each other in a floor-shaped way and configured to protrude into the feeder pit.

In some embodiments, the carrying structures form retaining floors having a distance from one another in the conveying direction such that the piece goods can incline increasingly while moving on the second pit delimitation in the conveying direction until the piece goods slide off the carrying structures of one retaining floor onto the carrying structures of the retaining floor directly below.

In some embodiments, the carrying structures are formed in the conveying direction in distances from 0.1 to 20 mm and/or have a depth from 1 to 10 mm orthogonally to the conveying direction.

In some embodiments, areas of the second pit delimitation located opposite to the carrying structures are formed for smooth guiding of the piece goods and have a roughness of less than 1 mm.

In some embodiments, a clear span smaller than a lateral extension of the piece goods is defined between the carrying structures and the second pit delimitation.

In some embodiments, the carrying structures comprise an essentially horizontally aligned toothing or corrugation.

In some embodiments, the feeder pit is inclined by up to 45° in relation to a vertical plane. In some embodiments, the feeder pit is inclined by up to 30° in relation to a vertical plane.

In some embodiments, the first and second pit delimitations are formed as walls with slits extending in the conveying direction for a lateral access to the piece goods.

In some embodiments, the feeder pit consists of at least one molded plastic part and is formed as one part.

In some embodiments, the first pit delimitation is fastened replaceably on the feeder pit.

In some embodiments, at least one of the first pit delimitation and the second pit delimitation is formed displaceably in a direction orthogonal to the conveying direction.

In some embodiments, the invention provides method for separating piece goods made of flat material comprising film cuts or blank bags, comprising docking a first batch feeder as described above filled with first piece goods in a working area of an extraction device comprising at least one suction gripper; extracting the first piece goods individually by means of the extraction device; and replacing the first batch feeder with a second batch feeder as described above filled with second piece goods during or after extraction of the first piece goods.

In some embodiments, the invention provides a method for stocking and gravity conveying of piece goods made of flat material comprising foil cuts or blank bags, comprising inputting the piece goods from above, in batches, into a feeder pit with two lateral pit delimitations comprising a first pit delimitation and a second pit delimitation located opposite to one another, wherein the piece goods are input such that a lateral extension of the piece goods is larger than a clear span of the feeder pit defined between carrying structures formed on the first pit delimitation that protrude into the feeder pit on respective floors and the second pit delimitation located respectively opposite; and provisionally retaining one end of the piece goods by the carrying structures while an opposite end of the piece goods is advancing in conveying position and being supported by preceding piece goods.

In some embodiments, the piece goods incline themselves, due to the preceding piece goods advancing in conveying position, as far as to slide off the carrying structures into retaining floors formed under said carrying structures or into an extraction area of the feeder pit.

In some embodiments, the piece goods are retained in batches against falling out in the area of a lower opening of the feeder pit and the piece goods are pulled individually out of the lower opening, by means of suction, while subsequent piece goods are advancing in conveying position.

In some embodiments, the piece goods are input with a lateral extension in the direction of the clear span that is 0.1% to 5% larger than the clear span.

In some embodiments, the piece goods are blank bags with an inward-folded bottom, and guided with their bottom side on the second pit delimitation.

In some embodiments, a thickness of the piece goods amounts to a maximum of 5% of the lateral extension. In some embodiments, a thickness of the piece goods amounts to a maximum of 1% of the lateral extension.

Additional features and advantages of the present invention are described further below. This summary section is meant merely to illustrate certain features of the invention, and is not meant to limit the scope of the invention in any way. The failure to discuss a specific feature or embodiment of the invention, or the inclusion of one or more features in this summary section, should not be construed to limit the invention as claimed.

BRIEF DESCRIPTION OF THE DRAWINGS

The foregoing summary, as well as the following detailed description of the preferred embodiments of the application, will be better understood when read in conjunction with the appended drawings. For the purposes of illustrating the systems and methods of the present application, there are shown in the drawings preferred embodiments. It should be understood, however, that the application is not limited to the precise arrangements and instrumentalities shown. In the drawings.

DETAILED DESCRIPTION

Figure 1:
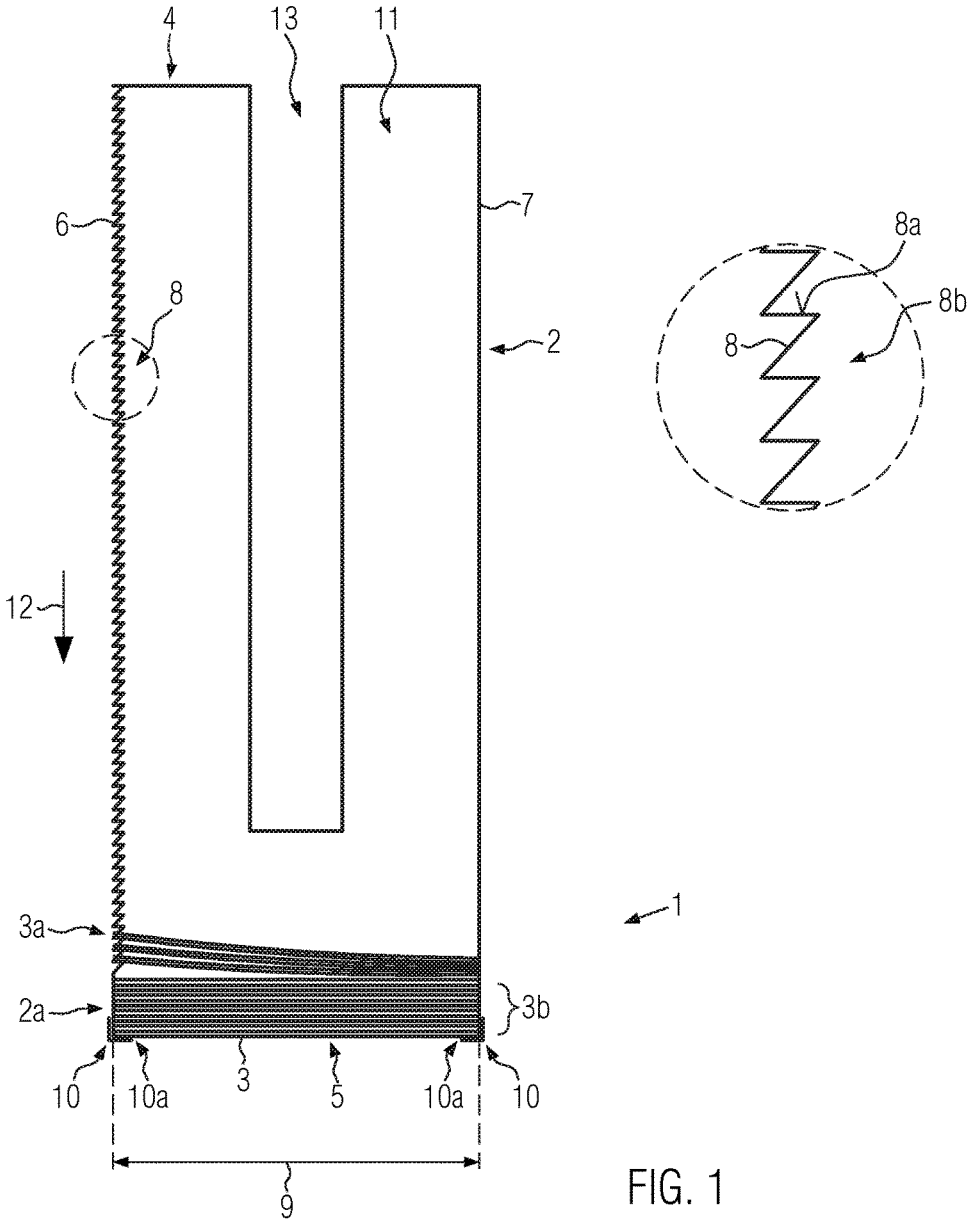
FIG. 1 shows a schematic lateral section through a first preferred embodiment of a batch feeder, according to some embodiments of the invention.

Particularly high requirements exist for bag-shaped piece goods that are available in a longitudinally folded form and that have an inward-folded bag bottom in addition. These piece goods are thicker in the area of the bag bottom than in its spout opening on the opposite end. Such thickness differences can be even more pronounced in piece goods with functional elements formed on one side, for example zippers, membranes or the like. During stacking in straight pits, this leads to an oblique position of the piece goods, which increases towards the top, so that only relatively low stacks are possible.

To be able to automatically provide a larger number of said piece goods in a batch feeder, DE 101 25 501 A1 suggests a drum-shaped batch feeder with two pit walls that are located opposite to one another and curved in an arc-shaped fashion. The thicker bag bottoms are then led along the pit wall with the larger curvature radius. For a gravity conveying mechanism of the piece goods, the drum-shaped batch feeder is eventually turned further step by step.

The disadvantage of this concept consists in the drum curvatures having to be adapted to the respective bag thicknesses, the capacity of such batch feeders also leaving room for improvement and the structure and the operation of the rotatable drum being work-intensive.

There is consequently a need for a batch feeder and a method for stocking and gravity conveying of piece goods made of flat material in which the difficulties mentioned above can be overcome at least partially. In particular, it is desirable to provide a batch feeder with a structure that is as simple as possible and that has a small number of moved components.

The assigned task is solved with a batch feeder according to the present invention. According to the invention, said batch feeder comprises a feeder pit for stocking and gravity conveying of piece items made of flat material on which an upper opening for feeding, in particular in batches, of the piece items, and a lower opening for extraction of the piece items, are positioned in between at least two lateral pit delimitations that are located opposite to each other for guiding of the piece items.

According to the invention, carrying structures, which are disposed in floors above one another and which protrude into the feeder pit, for one-sided support of the piece goods are formed on at least one of the pit delimitations that are located opposite to one another. The carrying structures form retaining floors on one side for provisional retention of the piece goods. The carrying structures are stationary during the operation of the batch feeder.

The first and second carrying structures do not have to be formed continuously on only one specific side of the feeder pit but can be formed as vertical sections of the feeder pit, respectively positioned opposite to one another on different sides of the feeder pit.

The feeder pit is suitable for both flat material with a uniform thickness in the lateral extension as well as for flat material with an asymmetric thickness in the lateral extension, for example for longitudinally folded blank bags with an infolding in the area of the bag bottom. Asymmetric piece goods are in particular goods that are thicker in the area of an infolding, a zipper or a functional membrane than in an opposite end section.

Lateral extension of the piece goods refers to the one that extends in the batch feeder from the first to the second pit delimitation. The lateral extension can for example be a longitudinal extension that is defined between a bag bottom and an opposite spout side or a transversal extension that is defined orthogonally to said longitudinal extension. Through stacking with a transversal extension from the first to the second pit delimitation, it can for example be avoided that longish piece goods bend in an undesired way while being supported on the carrying structures.

Asymmetric piece goods are fed into the batch feeder preferably in a way that their thicker ends, for example infolded bag bottoms or ends with zippers, membranes or the like, are led on the pit delimitation that faces away from the carrying structures. Accordingly, the thinner ends of the piece goods can support themselves one-sidedly on the carrying structures. The supported thinner ends are at first retained by the carrying structures while the stack is advancing and will finally slide automatically off the carrying structures if the preceding piece goods advance continuously. This effective principle also works with piece goods with an even thickness.

The piece goods are in particular blank bags with an inward-folded (infolded) bottom area. Then, the piece goods on the infolded end are essentially twice as thick as on their opposite end. For example the length of the infolded area amounts to a third to a tenth of the lateral extension of the piece goods. Such blank bags consist preferably of a thermoplastic material and are for example used for packaging beverages, cosmetic items, blood reserves or the like. The piece goods are in particular stand-up bags that are used in the fields of the food industry, pharmacology or in the cosmetics sector for packaging of liquid or solid substances. Such bags are mostly made of plastic films or aluminum-plastic laminates whose edges are connected in a suitable way, in particular through welding. But the piece goods can also be sleeves, foil cuts in general, cardboard cuts or the like.

A flat material shall generally be understood as the piece goods having at least one lateral extension that exceeds their thickness by a multiple, in particular at least twenty times.

The batch feeder is suitable both for essentially inflexible flat material in the sense of self-carrying, as well as for flexible flat material, in the sense of not self-carrying.

The carrying structures preferably form retaining floors on one side and have such a distance from one another in the conveying direction that the piece goods can bend increasingly while advancing on the pit delimitation that is opposite to the carrying structures until they slide off the carrying structures into the respective next lower retaining floor. In case of the gravity conveying mechanism, the piece goods are supported, individually or in batch sections, on the carrying structures of the retaining floor in a provisional and one-sided way. On their opposite ends, the piece goods are supported continuously by preceding piece goods.

In relation to the horizontal plane or to a plane that is orthogonal to the conveying direction, the piece goods slide off the carrying structures for example when there is an inclination angle from 1 to 45°, in particular when there is an inclination angle from 10 to 20°. In case of flexible piece goods, the inclination angle is defined at the contact point on the carrying structure.

The batch is segmented on the carrying structures and the batch weight is therefore distributed over multiple retaining floors of the feeder pit. This leads in particular to a relief of a batch retainer that is formed on the lower end of the feeder pit. Further, an oblique stacking of asymmetric piece goods can be compensated on each floor. The carrying structures are stationary so that switching mechanisms, conveyor drives, control units and the like are dispensable for gravity conveying within the feeder pit.

The carrying structures are formed preferably in the conveying direction at distances from 0.1 to 20 mm and/or have a depth from 1 to 10 mm that is orthogonal to the conveying directions. Piece goods with different thicknesses, asymmetry, bending stiffness and lateral extension (between the lateral pit delimitations) can be provided within the above value ranges by means of a gravity conveying mechanism that is relieved on each floor. Between the carrying structures, uniform distances are formed preferably in the batch direction, continuously or rather only in sections. Such uniform distances, however, can also be formed in any vertical distribution patterns within the above value range. Likewise, the distances can be adapted precisely to the stacking behavior of the piece goods in an area directly above an extraction area of the feeder pit in order to optimize the lowest batch section.

Preferably, areas of the second pit delimitation for flexible guiding of the piece goods that are located opposite to the carrying structures are formed and have in particular a roughness of less than 1 mm. This enables a quasi-continuous advancing process of the piece goods on the pit delimitation that is located opposite to the carrying structures.

The carrying structures preferably define a clear span, which is smaller than the lateral extension of the piece goods that is associated and/or that has the same direction, to the respective pit delimitation that is located opposite. Hence, for example piece goods that are aligned orthogonally to the conveying direction support themselves reliably on the carrying structures. In other words, the piece goods overlap with the carrying structures in case of an orthogonal orientation.

In case of an increasingly oblique position of the piece goods, said piece goods slide downwards on the uncovered upper edge of the carrying structures and eventually onto the next lower retaining floor. For gravity conveying of the piece goods on each floor, the clear span is adapted to the lateral extension of the piece goods or reversed.

The carrier structures are formed preferably in the form of an essentially horizontally extending toothed or corrugated installation, in particular consisting of a random number of horizontally aligned and/or successive teeth/corrugations. The respective upper tooth flanks then form retaining floors. The toothing is for example formed in form of a horizontally continuous sawing tooth or a horizontally aligned row of sawing teeth, in particular with essentially horizontal upper tooth flanks. A corrugation shall essentially be understood as a toothing with rounded edges. The toothing or corrugation is preferably formed with a uniform tooth spacing and/or corrugation spacing. By means of a toothing or corrugation, the batch of piece goods can be segmented into a plurality of batch sections. Likewise, individual piece goods can support themselves provisionally on the individual retaining floors.

An area of the feeder pit that is adjacent to the lower opening is formed preferably without toothing/corrugation in this case so that the piece goods adjacent to the lower opening take on a reproducible position, for example with regard to a batch retainer that is formed there. Hence, the piece goods can be taken over at a reproducible point by a suction gripper or the like.

The feeder pit is preferably inclined by up to 45° with regard to the vertical plane, in particular by up to 30°. Then, preferably both pit delimitations that are located opposite to one another are inclined in parallel to one another in a way that one of the pit delimitations essentially has an overhanging position. The overhanging pit delimitation is then preferably the one with the carrying structures. Consequently, the piece goods slide laterally against the pit delimitation that is located opposite to the carrying structures in the sense of the lateral end stop. Therefore, the lateral positioning of the piece goods on the retaining floors can be reproduced particularly well. Accordingly, the transition from retention of the piece goods to sliding off on the retaining floors is predetermined accurately.

Preferably, the pit delimitations are formed as walls with slits 13 in the conveying direction for lateral access to the piece goods. This enables for example manual basic filling, partial filling or supplementary filling of the batch feeder. Likewise, automated filling of the batch feeder by means of a stacker that is appropriate for lateral access or the like is possible.

Each of the pit delimitations could also consist of at least two guiding rails located next to one another or the like. In particular for the pit delimitation that is opposite to the carrying structures, a pit delimitation that is particularly well observable and well accessible could therefore be provided. In other words, the feeder pit could be formed in form of a cage with guiding rails positioned in the conveying direction, wall segments or the like.

The feeder pit consists preferably of at least one molded plastic part and is in particular formed as one piece. Batch feeders of this type can be manufactured cost-efficiently in large numbers and are in particular suitable as transportable units in order to transport and charge the piece goods jointly with the batch feeders and to lead the batch feeders back into the product cycle after emptying and replacement.

The first pit delimitation is preferably fastened replaceably on the feeder pit. The feeder pit can then be adapted easily to different piece goods, in particular for adaptation to the thickness and/or bending stiffness of the piece goods.

The first and/or second pit delimitation is preferably formed in a displaceable way orthogonally to the conveying direction in relation to the feeder pit. The feeder pit can then be adapted easily to different piece goods, in particular for adaptation to the lateral extension of the piece goods.

A batch retainer is preferably formed in the area of the lower opening, in particular on at least two pit delimitations. The batch retainer is then formed in a way that it prevents self-discharge of the batch feeder due to gravity. The lowest piece good is supported by the batch retainer in such a way that the lowest batch section cannot fall out of the feeder pit. Rather, the batch retainer is formed in a way that the lowest piece good can be pulled out of the lowest opening and/or of the batch retainer by a suction gripper or another gripping mechanism. Hence, a controlled extraction of individual piece goods is enabled.

Further, the batch feeder comprises preferably at least one suction gripper for individual extraction of the piece goods from the batch retainer. Suction grippers are suitable for different materials such as plastic foils, cardboard packaging materials or the like and enable a controlled transfer of the piece goods for further processing.

The assigned task is also solved with a method according to the present invention. On this basis, said method is used for separating piece goods made of flat material, in particular of foil cuts or blank bags, wherein a batch feeder filled with the piece goods according to at least one of the preceding embodiments is docked on in the working area of an extraction device that comprises in particular at least one suction gripper, and wherein the piece goods are extracted separately by means of the extraction device. The batch feeder is further replaced by another batch feeder filled with piece goods during or after extraction of the piece goods. Therefore, filling of the piece goods into the batch feeder in the working area of the separating station becomes dispensable.

The filled batch feeders are therefore provided as transportable units wherein the piece goods are secured against falling out of the batch feeders for example by means of batch retainers, lids and/or transport packagings. Emptied batch feeders can be reused.

For example an appropriate docking station with suitable guidings, detachable fasteners or the like in the area of the extraction device is formed for the batch feeders. There are preferably two docking stations that can be operated alternatingly and/or two extraction devices that can be operated alternatingly. Therefore, a smooth transfer between an emptied and a filled batch feeder is enabled and hence a continuous separation of the piece goods, for example for further transportation of the separated piece goods as a continuous product flow to machines for the production of beverage packagings and/or for filling of a beverage or another product.

Likewise, the assigned task is solved with another method according to the present invention. On this basis, said method is used for stocking and gravity conveying of piece goods made of flat material, in particular of foil cuts or bags. The piece goods are in particular input from above in batches into a batch feeder with two lateral pit delimitations that are located opposite to one another. According to the invention, the piece goods are input in such a way that a lateral extension of the piece goods is larger than a clear span of the batch feeder that is assigned to said extension and that is defined between carrying structures that protrude into the feeder pit on the respective floors and the pit delimitation that is located respectively opposite. Further, an end of the piece goods is retained temporarily by the carrying structures in case of gravity conveying while the opposite end of the piece goods advances while being supported by preceding piece goods. The advancing process is caused by the individual extraction of the respective lowest piece good.

Through advancing of the preceding piece goods, the piece goods are preferably inclined so far that they slide off from the carrying structures into retaining floors that are formed underneath or into an extraction area of the feeder pit.

The piece goods are preferably retained in batches against falling out in the area of a lower opening of the feeder pit, and the piece goods are pulled out individually of the lower opening while subsequent piece goods are advancing. Hence, the piece goods can be separated reliably and high support weights on the batch retainer can be prevented in the process.

The piece goods are preferably input with an extension in the direction of the clear span that is 0.5% to 5% larger than the clear span. This enables retention on the carrying structures on the respective floor for differently thick and/or rigid piece goods and a reliable slide-off process from the carrying structures through oblique positioning.

The piece goods are preferably blank bags, in particular bags with an inward-folded bottom, and are guided with their bottom side on the pit delimitation that is opposite to the carrying structures. Hence, oblique stacking due to an asymmetric wall thickness distribution on the individual retaining floors can be compensated. But it is also possible to stack bags of this type in an orientation that is turned by 90° in relation to the aforementioned arrangement so that a side that connects the bag bottom and the spout end is retained by the carrying structures on the respective floor.

The thickness of the piece goods preferably amounts to a maximum of 5% of the lateral extension, in particular to 1% as a maximum. The thickness of the piece goods is defined in this context by their maximum value that is reached for example in the area of an inward-folded foil section. Piece goods of said type are particularly suitable for gravity conveying on the respective floor by means of carrying structures that are formed essentially as a horizontal toothing or corrugation.

As can be seen in FIG. 1, the batch feeder 1 comprises a feeder pit 2 for stocking and gravity conveying of piece goods 3 made of flat material. An upper opening 4 for in particular batch-based input of the piece goods 3 and a lower opening 5 for individual extraction of the piece goods 3 is formed on the feeder pit 2.

The feeder pit 2 comprises a first lateral pit delimitation 6 for retention on one side of individual piece goods 3 or of batch sections 3*a* consisting of piece goods 3. The feeder pit 2 further comprises a second lateral pit delimitation 7 located opposite for smooth guiding of the piece goods 3 or batch sections 3*a*. The first pit delimitation 6 comprises carrying structures 8 that are arranged on top of each other in a floor-shaped way with supporting surfaces 8*a* for form-closing retention of piece goods 3 with a lateral extension 9. The carrying structures 8 are formed for example as an essentially horizontally aligned toothing 8*b*.

In the area of the lower opening 5, at least one batch retainer 10 is formed that prevents the loaded batch feeder 1 from discharging by itself in a downward direction through the influence of gravity. The batch retainer 10 comprises at least two supporting surfaces 10*a* for a lower batch section 3*b* that is absorbed by an extraction area 2*a* without carrying structures 8 that is formed on a lower end of the feeder pit 2.

The lateral pit delimitations 6, 7 are connected to one another through pit walls 11 or similar structures of which only one is displayed exemplarily in FIG. 1.

Recesses 13, which are respectively opposite to one another and extending in the conveying direction 12 and which enable lateral access to the inside of the feeder pit 2, for example to insert a stack of piece goods 3 into the feeder pit 2, are preferably formed in the first and second pit delimitation 6, 7 and/or in the connecting pit walls 11.

Figure 2:
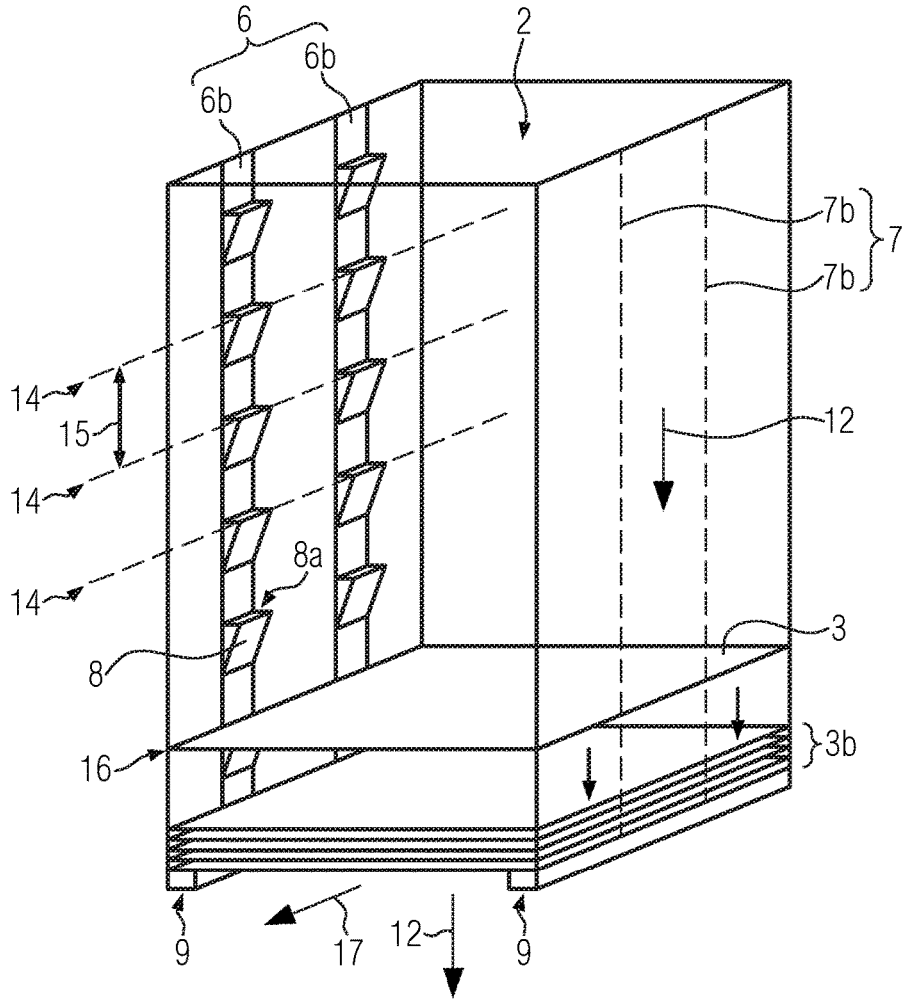
FIG. 2 shows a schematic isometric view of a second embodiment of a batch feeder, according to some embodiments of the invention.

As illustrated schematically and not drawn to scale in FIG. 2, the carrying structures 8 are formed for the respective floors in the feeder pit 2. The support areas 8*a* of the carrying structures 8 form retaining floors 14 that retain individual piece goods 3 or batch sections 3*a* temporarily and on only one side during gravity conveying. The supporting surfaces 8*a* are arranged in vertical distances 15 to one another that are adapted to the lateral extension 9, a thickness 16 and/or a bending stiffness of the piece goods 3.

As further displayed schematically in FIG. 2, the first pit delimitation 6 can for example consist of at least two rails 6*b*, which are preferably vertical or also tilted in relation to the vertical plane, on which the carrying structures 8 are formed in form of cantilever consoles or the like. Equally, the pit delimitations 6, 7 and the pit walls 11 can be formed essentially as a cage that comprises, preferably in the area of the second pit delimitation 7, further (only schematically indicated) guiding rails 7*b* or the like for smooth guiding of the piece goods 3.

In principle, the feeder pit 2 can have any cross-section, provided that pit walls 6, 7 that are located opposite to one another are adapted appropriately to the shape, thickness and/or bending stiffness of the piece goods 3 and in addition comprise retaining floors 14 on one side. Likewise, the feeder pit 2 could be inclined against the vertical plane, provided that the piece goods 3 advance due to the effect of gravity. The inclination in relation to the vertical plane then amounts for example to a maximum of 45°, in particular to a maximum of 30°.

The extraction of the individual piece goods 3 from the feeder pit 2 preferably takes place in the conveying direction 12 but is possible in a direction 17 that is orthogonal to said conveying direction in case of stiff piece goods 3, for example by means of transport rollers, suction grippers or the like.

Figure 3A:
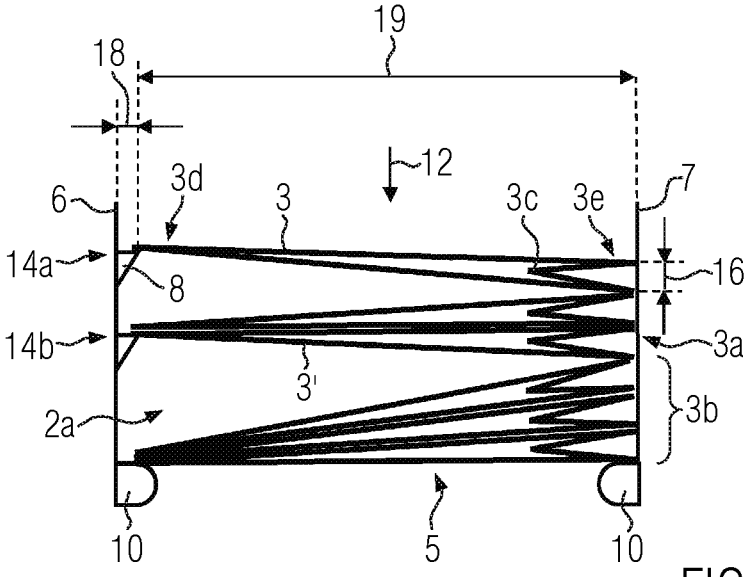
FIGS. 3A and 3B show a schematic diagram of a method of using a batch feeder of the present invention, according to some embodiments.
Figure 3B:
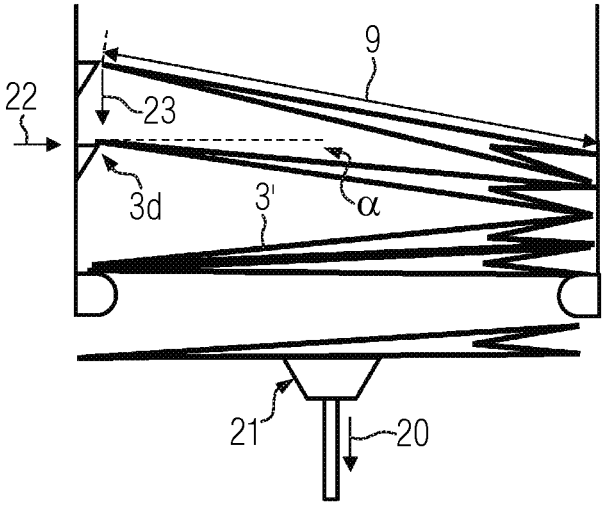

FIGS. 3A and 3B schematically illustrate the function of the batch feeder 1. For the sake of simplicity, only the first pit delimitation 6 with its two lowest carrying structures 8, the second pit delimitation 7 located opposite to said first pit delimitation and the lower batch retainer 10 are displayed. The carrying structures 8 form with their supporting surfaces 8*a* an upper retaining floor 14*a* and a lower retaining floor 14*b*. Underneath, there is the extraction area 2*a* in which a lower batch section 3*b* is supported by the batch retainer 10.

The piece goods 3 are displayed exemplarily as blank bags with an infolding 3*c* in the area of the bag bottom. Consequently, the piece goods 3 have a thickness 16 (displayed in an exaggerated way) in the area of the infolding that is larger than on the opposite spout end of the blank bag. The thickness 16 of the goods 3 along the lateral extension 9 is consequently distributed asymmetrically.

The carrying structures 8 have a depth 18 of preferably 1 to 10 mm orthogonally to the conveying direction 12.

A clear span 19, which is smaller than the lateral extension 9 of the piece goods 3 (when aligned orthogonally to the conveying direction 12) that is defined with the same direction, is defined between the second pit delimitation 7 and the carrying structures 8.

Piece goods 3 with an asymmetric thickness distribution are retained provisionally and in a form-closing way on their thinner ends 3*d* by the carrying structures 8 on the retaining planes 14, 14*a*, 14*b*. In contrast to this, the thicker ends 3*e* of the piece goods 3 are continuously positioned on top of each other during gravity conveying and can slide downwards in an unhampered way on the second pit delimitation 7 so that they advance by one conveying position in a downward direction with each extraction 20 of a piece good 3 by means of gravity.

FIG. 3B shows a state according to which the two lowest piece goods 3 of FIG. 3A were extracted from the extraction area 2*a* by means of an extraction device 21, for example by means of a suction gripper. The extraction 20 of flexible piece goods 3 takes place for example in the conveying direction 12, for example by pulling the piece goods 3 out of the stack retainer 10. The function of extraction devices 21 and associated actuating mechanisms is known in principle and therefore not explained in greater detail.

As a consequence of the extraction 20 of the two lowest piece goods 3 from the batch section 3*b* of FIG. 3A, the piece goods 3 following said lowest piece goods have advanced in a downward direction on the second pit delimitation 7 so that the piece goods 3 that are supported on one side by the carrying structures 8 have inclined themselves in FIG. 3B. Hence, a central piece good 3' has slidden off the lower retaining floor 14*b* into the extraction area 2*a*. Further, the upper piece good 3 of FIG. 3B slides off evenly from the carrying structure 8 of the upper retaining floor 14*a* into the lower retaining floor 14*b*.

Retention 22 and advancing 23 on the respective floor are marked by arrows in FIG. 3B. The advancing process on the second pit delimitation 7 that is caused directly during extraction 20 of piece goods 3 leads, depending on the inclination angle .alpha. of the individual piece goods 3, either to retention 22 on the respective carrying structures 8 or to a an advancing process 23 on the respective floor into the next lower retaining floor 14. In case of gravity conveying of the piece goods 3, phases of retention 22 and phases of advancing 23 consequently occur alternatingly on the side of the first pit delimitation 6.

The carrying structures 8 hereby compensate an asymmetric thickness distribution of the piece goods 3 and therefore also enable reliable and even gravity conveying of the piece goods 3 over the whole length of the feeder pit 2, also in a feeder pit 2 that has a straight and upward position. Nevertheless, a functionally equal gravity conveying process is also ensured in case of an even thickness distribution of the piece goods 3.

Preferably, the lateral extension 9 of the piece goods 3 is 0.1 to 5% larger than the clear span 19. The extension 9 in case of stiff piece goods 3 can hereby be smaller than in case of flexible piece goods 3 for example film cuts, film bags or the like.

The first and second pit delimitation 6, 7 can be inclined by up to 45° in relation to the vertical plane, in particular by up to 30°. The first pit delimitation 6 can then in particular be formed in an essentially overhanging way. Consequently, the piece goods 3 slide laterally against the second pit delimitation 7 that works consequently as a lateral end stop for the piece goods 3. In principle, however, also an opposite inclination of the feeder pit 2 would be possible.

The first pit delimitation 6 can in addition be formed replaceably on the batch feeder 1 in order to adapt said pit delimitation to different piece goods 3 with low material expenditures and a low workload.

Likewise, the batch feeder 1 can be embedded, where required also in pairs, in the area of the extraction device 21 in a way as to be quickly exchangeable in order to replace for example emptied batch feeders 1 with readily loaded available batch feeders 1. Carrying racks, guidings, couplings or the like, which are suitable for docking, for batch feeders 1 are known in principle and therefore not displayed.

Due to the piece goods 3 being supported by the carrying structures 8 on the respective floor, the batch retainer 10 is only charged by the lower batch section 3*b*. Therefore, batch retainers 10 and suction grippers 21 can work with a comparably low effort. This reduces the machine workload and the wear for and/or during extraction 20.

The batch feeder 1 can be used to work as follows:

A batch with piece goods 3 is for example filled manually from above into the feeder pit 2. The piece goods 3 hereby have a lateral extension 9 defined between the lateral pit delimitations 6, 7 that is larger than the clear span 19 between the carrying structures 8 and the second pit delimitation 7. The piece goods 3 are filled into the feeder pit 2 in such a way that they are positioned on top of one another on their ends 3*e* that face the second pit delimitation 7.

Alternatively, the batch feeders 1 can be made available in a readily loaded form and docked in the area of the extraction device 21.

Through successive extraction 20 of individual piece goods 3 in the area of the batch retainers 10, the piece goods 3 advance directly on their ends 3*e* that face the second pit delimitation 7. Depending on the inclination angle α of the piece goods 3, which thereby results on the carrying structures 8, said piece goods are retained on one side by the carrying structures 8 or slide off said carrying structures on one side and into the next lower retaining floor 14. The piece goods slide off for example when a predetermined inclination angle α from 1 to 45°, on particular from 5 to 30° is exceeded.

Separation of the piece goods 3 takes place in the area of the batch retainer 10 with a comparably low effort. The extracted piece goods 3 can therefore be provided reliably for further processing.

The batch feeder 1 is either refilled in-situ during the running separation process or replaced by a batch feeder 1 that is readily filled with piece goods 3. A replacement preferably takes place after complete emptying of the respective batch feeder 1 and/or is possible in a particularly advantageous way in case of alternating operation in the area of the extraction device 21 of batch feeders 1 that are docked in a temporally overlapping manner.

Gravity conveying on the respective floors does not require any flexible conveyors between the upper opening 4 and the lower opening 5 of the feeder pit 2. This simplifies the view into the feeder pit 2 as well as access for loading the feeder 2. Likewise, sources of risk due to moved machine parts are minimized. In addition, the batch feeder 1 is particularly easy to clean.

Through the elimination of moved components in the area of the feeder pit 2, the carrying structures 8 and/or the associated pit delimitation 6 can in addition be replaced comparably easily for a format change. Likewise, the batch feeder 1 can be formed as a multi-format feeder with a low mechanical effort as for example the clear span 19 can be adapted through simple displacement of the first and/or second pit delimitation 6, 7 orthogonally to the conveying direction 12.

Further, stable batch levels in the individual retaining floors 14 and in the extraction area 2*a* of the feeder pit 2 can be maintained also in case of different filling levels of the batch feeder 1. The risk of congestion of the piece goods 3 in the feeder pit 2 is consequently reduced.

While there have been shown and described fundamental novel features of the invention as applied to the preferred and exemplary embodiments thereof, it will be understood that omissions and substitutions and changes in the form and details of the disclosed invention may be made by those skilled in the art without departing from the spirit of the invention. Moreover, as is readily apparent, numerous modifications and changes may readily occur to those skilled in the art. Hence, it is not desired to limit the invention to the exact construction and operation shown and described and, accordingly, all suitable modification equivalents may be resorted to falling within the scope of the invention as claimed. It is the intention, therefore, to be limited only as indicated by the scope of the claims appended hereto.

What is claimed is:

1. A batch feeder, comprising a feeder pit for stocking and gravity conveying of piece goods made of flat material in a downward conveying direction, the feeder pit comprising an upper opening for batch-based feeding of the piece goods, a lower opening for extraction of the piece goods, and at least two lateral pit delimitations comprising a first pit delimitation and a second pit delimitation located opposite to one another for guiding of the piece goods, each pit delimitation comprising an interior surface facing the feeding pit, wherein the interior surface of the first pit delimitation comprises carrying structures formed thereon for supporting the piece goods on one side, the carrying structures arranged on top of each other and configured to protrude into the feeder pit, and wherein the interior surface of the second pit delimitation opposite the interior surface of the first pit delimitation comprising the carrying structures is substantially smooth along its entire length, having a roughness of less than 1 mm and formed for smooth guiding of the piece goods, wherein the carrying structures form retaining floors having a distance from one another in the conveying direction such that the piece goods can incline increasingly while moving on the second pit delimitation in the conveying direction until the piece goods slide off the carrying structures of one retaining floor onto the carrying structures of the retaining floor directly below.

2. The batch feeder according to claim 1, wherein the carrying structures are formed in the conveying direction in distances from 0.1 to 20 mm.

3. The batch feeder according to claim 1, wherein the carrying structures have a depth from 1 to 10 mm orthogonally to the conveying direction.

4. The batch feeder according to claim 1, wherein a clear span smaller than a lateral extension of the piece goods is defined between the carrying structures and the second pit delimitation.

5. The batch feeder according to claim 1, wherein the carrying structures comprise an essentially horizontally aligned toothing or corrugation.

6. The batch feeder according to claim 1, wherein the first and second pit delimitations are connected to one another through pit walls, wherein the connecting pit walls comprise recesses opposite to one another and extending in the conveying direction for a lateral access to the piece goods inside the feeder pit.

7. The batch feeder according to claim 1, wherein the feeder pit consists of at least one molded plastic part and is formed as one part.

8. The batch feeder according to claim 1, wherein the first pit delimitation is fastened replaceably on the feeder pit.

9. A method for separating piece goods made of flat material comprising film cuts or blank bags, comprising:

docking a first batch feeder according to claim 1 filled with first piece goods in a working area of an extraction device comprising at least one suction gripper;

extracting the first piece goods individually by means of the extraction device; and replacing the first batch feeder with a second batch feeder according to claim 1 filled with second piece goods during or after extraction of the first piece goods.

10. The batch feeder according to claim 1, wherein the interior surface of the first pit delimitation includes an extraction area without carrying structures that is formed on a lower end of the feeder pit.

11. The batch feeder according to claim 1, further comprising a batch retainer formed at the lower opening, the batch retainer comprising at least two supporting surfaces for a lower batch section of piece goods.

12. A method for stocking and gravity conveying of piece goods made of flat material comprising foil cuts or blank bags, comprising:

inputting the piece goods from above, in batches, into a feeder pit with two lateral pit delimitations comprising a first pit delimitation and a second pit delimitation located opposite to one another, wherein the piece goods are input such that a lateral extension of the piece goods is larger than a clear span of the feeder pit defined between carrying structures formed on an interior surface of the first pit delimitation that protrude into the feeder pit on respective floors and the second pit delimitation located respectively opposite, the second pit delimitation having an interior surface opposite the interior surface of the first pit delimitation comprising the carrying structures that is substantially smooth along its entire length, having a roughness of less than 1 mm and formed for smooth guiding of the piece goods; and provisionally retaining one end of the piece goods by the carrying structures while an opposite end of the piece goods is advancing in conveying position and being supported by preceding piece goods.

13. The method according to claim 12, wherein the piece goods incline themselves, due to the preceding piece goods advancing in conveying position, as far as to slide off the carrying structures into retaining floors formed under said carrying structures or into an extraction area of the feeder pit.

14. The method according to claim 12, wherein the piece goods are retained in batches against falling out in the area of a lower opening of the feeder pit and the piece goods are pulled individually out of the lower opening, by means of suction, while subsequent piece goods are advancing in conveying position.

15. The method according to claim 12, wherein the piece goods are input with a lateral extension in the direction of the clear span that is 0.1% to 5% larger than the clear span.

16. The method according to claim 12, wherein the piece goods are blank bags with an inward-folded bottom, and guided with their bottom side on the second pit delimitation.

17. The method according to claim 12, wherein a thickness of the piece goods amounts to a maximum of 5% of the lateral extension.

18. The method according to claim 12, wherein a thickness of the piece goods amounts to a maximum of 1% of the lateral extension.

19. A batch feeder, comprising a feeder pit for stocking and gravity conveying of piece goods made of flat material in a downward conveying direction, the feeder pit comprising an upper opening for batch-based feeding of the piece goods, a lower opening for extraction of the piece goods, and at least two lateral pit delimitations comprising a first pit delimitation and a second pit delimitation located opposite to one another for guiding of the piece goods, each pit delimitation comprising an interior surface facing the feeding pit, wherein the interior surface of the first pit delimitation comprises carrying structures formed thereon for supporting the piece goods on one side, the carrying structures arranged on top of each other and configured to protrude into the feeder pit, and wherein the interior surface of the second pit delimitation is substantially smooth, having a roughness of less than 1 mm and formed for smooth guiding of the piece goods, wherein the carrying structures form retaining floors having a distance from one another in the conveying direction such that the piece goods can incline increasingly while moving on the second pit delimitation in the conveying direction until the piece goods slide off the carrying structures of one retaining floor onto the carrying structures of the retaining floor directly below, and wherein the first pit delimitation comprises at least two rails on which the carrying structures are formed.

20. A batch feeder, comprising a feeder pit for stocking and gravity conveying of piece goods made of flat material in a downward conveying direction, the feeder pit comprising an upper opening for batch-based feeding of the piece goods, a lower opening for extraction of the piece goods, and at least two lateral pit delimitations comprising a first pit delimitation and a second pit delimitation located opposite to one another for guiding of the piece goods, each pit delimitation comprising an interior surface facing the feeding pit, wherein the interior surface of the first pit delimitation comprises carrying structures formed thereon for supporting the piece goods on one side, the carrying structures arranged on top of each other and configured to protrude into the feeder pit, and wherein the interior surface of the second pit delimitation is substantially smooth, having a roughness of less than 1 mm and formed for smooth guiding of the piece goods, wherein the carrying structures form retaining floors having a distance from one another in the conveying direction such that the piece goods can incline increasingly while moving on the second pit delimitation in the conveying direction until the piece goods slide off the carrying structures of one retaining floor onto the carrying structures of the retaining floor directly below, wherein the second pit delimitation comprises one or more guiding rails for smooth guiding of the piece goods.

* * * * *